US009455526B2

(12) United States Patent
Morby et al.

(10) Patent No.: US 9,455,526 B2
(45) Date of Patent: Sep. 27, 2016

(54) CONDUCTOR CONNECTORS FOR POWER CABLES

(71) Applicant: PRYSMIAN CABLES & SYSTEMS LIMITED, Eastleigh, Hampshire (GB)

(72) Inventors: Luke Morby, Eastleigh (GB); Darren Michael Spiller, Eastleigh (GB); Stuart Cox, Eastleigh (GB)

(73) Assignee: PRYSMIAN CABLES & SYSTEMS LIMITED, Milan (IT)

( * ) Notice: Subject to any disclaimer, the term of this patent is extended or adjusted under 35 U.S.C. 154(b) by 84 days.

(21) Appl. No.: 14/340,556

(22) Filed: Jul. 24, 2014

(65) Prior Publication Data

US 2015/0031227 A1 Jan. 29, 2015

(30) Foreign Application Priority Data

Jul. 25, 2013 (GB) ..... 1313290.7

(51) Int. Cl.
*H01R 13/622* (2006.01)
*H01R 4/50* (2006.01)
*H01R 4/26* (2006.01)

(52) U.S. Cl.
CPC ..... *H01R 13/622* (2013.01); *H01R 4/5025* (2013.01); *H01R 4/26* (2013.01)

(58) Field of Classification Search
CPC ..... H01R 4/5025; H01R 4/5033
See application file for complete search history.

(56) References Cited

U.S. PATENT DOCUMENTS 939,501 A * 11/1909 Hinds ..... 403/308
1,646,660 A * 10/1927 Prince ..... 439/805
2,261,414 A * 11/1941 Rogoff ..... 439/784
2,279,508 A 4/1942 Bergan
2,339,488 A 1/1944 Kratoville
2,463,144 A 3/1949 Buchanan
2,463,145 A * 3/1949 Buchanan ..... 439/784
4,752,252 A * 6/1988 Cherry et al. ..... 439/784
5,573,423 A 11/1996 Lin et al.
5,683,273 A * 11/1997 Garver et al. ..... 439/784
6,488,548 B1 * 12/2002 Tomasino ..... 439/784
6,830,491 B1 * 12/2004 Tomasino ..... 439/784
7,351,101 B1 4/2008 Montena (Continued)

FOREIGN PATENT DOCUMENTS

CN 201918518 8/2011
CN 202034492 11/2011

(Continued)

OTHER PUBLICATIONS

Search Report from the European Patent Office for corresponding European Application No. EP 14176320.1, mailed Dec. 9, 2014.

(Continued)

*Primary Examiner* — Gary Paumen
(74) *Attorney, Agent, or Firm* — Finnegan, Henderson, Farabow, Garrett & Dunner, L.L.P.

(57) ABSTRACT

A connector for a conductor of a power cable includes a hollow outer member configured to at least partially surround an exposed section of the conductor and configured to exert a force in an axial direction onto at least one electrically conductive inner member, and at least one electrically conductive inner member configured to be interposed between the outer member and the conductor, and configured to exert a force in a radial direction onto the conductor in response to the force in an axial direction.

15 Claims, 9 Drawing Sheets

(56) References Cited

U.S. PATENT DOCUMENTS

| | | | | |
|---|---|---|---|---|
| 8,287,309 | B1 | 10/2012 | Thomas et al. | |
| 8,500,497 | B1 * | 8/2013 | Patten | 439/784 |
| 2002/0046865 | A1 | 4/2002 | Bertini et al. | |
| 2004/0192121 | A1 * | 9/2004 | Tomasino | 439/784 |

FOREIGN PATENT DOCUMENTS

| | | |
|---|---|---|
| DE | 1242731 | 6/1967 |
| DE | 200 06 397 | 9/2000 |
| DE | 202006000833 | 4/2006 |
| EP | 1237227 | 9/2002 |
| EP | 1 837 952 | 9/2007 |
| FR | 898732 | 5/1945 |
| GB | 2277207 | 10/1994 |
| WO | WO 2010/080960 | 7/2010 |
| WO | WO 2010/141880 | 12/2010 |

OTHER PUBLICATIONS

Search Report from the British Patent Office for priority British Application No. GB1313290.7 dated Jan. 22, 2014.

* cited by examiner

CONDUCTOR CONNECTORS FOR POWER CABLES

CROSS REFERENCE TO RELATED APPLICATION

This application claims the priority of British Patent Application No. 1313290.7, filed Jul. 25, 2013, the content of which is incorporated herein by reference.

BACKGROUND OF THE INVENTION

The present invention relates to connectors for power cables, more in particular for a conductor thereof.

In the present description and claims, under the term "connector", a connector for straight joints, a connector for a branch connection, a connector for breaches connections, a connector for service connections, a termination lug are encompassed as well as any other structures for connecting a conductor of a cable or the like.

Connectors for power cables are known in a variety of designs. Just as an example, U.S. 2002/0046865 A1 discloses some electrical connectors for a power cable. In one embodiment (FIG. 1 thereof), the connector comprises a tubular member with a first and second hollow portions, each sized and shaped to receive an end of a conductor. Hence, a portion of the cable that has been stripped to remove the outer insulation is inserted into each hollow portion. The ends of the cables are then secured to the connector by crimping each end of the connector.

In another embodiment (FIG. 11 thereof), an elongated hollow electrically conductive tubular member has a plurality of threaded openings sized to receive bolts to contact the central core of an electrical cable section when bolts are tightened.

The Applicant observes that the first connector has no range-taking ability and requires a special tool for connection, while in the second connector the screws may damage the strands of the conductor and only make local electrical connection.

EP 1837952 A2 discloses an electrical connector for corrugated coaxial cable which is installable upon an electrical cable, having a spring finger ring which can be applied to the cable by axial compression. The spring finger ring comprises a plurality of fingers with gaps between them. The fingers are jointed together at one end by the ring. The spring finger ring is located within a bore of a body coupled to the cable end. The fingers are allowed to be deflected outwards to allow the leading edge of the outer conductor to pass, and return to their steady, spaced state resting in the first corrugation behind the leading edge of the outer conductor.

The Applicant observes that the above connector has no range-taking ability and is only suitable for corrugated coaxial cables (i.e. cables used for communications, not for power transportation).

SUMMARY OF THE INVENTION

The Applicant found that when large size cables are to be connected, the force to be applied for fitting a connector over the conductors by crimping must be very high (e.g. a force of about 2500 N). Conductors with large sizes require a large hydraulic clamping equipment which has to be transported on the installation site. Typical compression connectors are designed to fit only specific sizes of conductors so that the operators must have many different types of connectors during installation. Sometimes the sites are very remote in cramped areas or involve connections at height which creates hard work for the fitters.

The Applicant, moreover, found that it is convenient to compress together the strands forming the conductor such that the lateral or radial forces applied to the strands are similar. When mechanical connectors are used, these type of connectors do not, have a full contact with the conductor as there is only a connection on the bottom surface of the connector. Further, when screws are used, they may not apply as much pressure as a compression die and do not compress all the strands together so that there is the likelihood of voltage differences between each layer of strands of the conductor.

In an aspect, the present invention relates to a connector for a conductor of a power cable, with an hollow outer member configured to at least partially surround an exposed section of the conductor and configured to exert a force in an axial direction onto at least one electrically conductive inner member, wherein the electrically conductive inner member is configured to be interposed between the outer member and the conductor, and it is configured to exert a force in a radial direction onto the conductor in response to the force in the axial direction.

In the present disclosure and in the attached claims, to exert a force in an axial direction encompasses that a force in a direction other than axial is also exerted.

In the present disclosure and in the attached claims, terms "outer" and "inner" are used relative to each other, not with an absolute meaning.

By providing for two nested members, the inner member being radially forced onto the conductor by the axial force from the outer member, the inner member may be shaped so as to have extensive contact with the conductor. Moreover, because the outer member needs only to apply an axial force instead of a compression onto the conductor, it is less sensitive to the size of the conductor and does not require special tools for assembling the connector onto the conductor.

Preferably, the connector further comprises a hollow counter member and the outer member is configured to engage with the counter member to exert the force in the axial direction.

Preferably the counter member is configured to contact an end portion of the conductor, more preferably to at least partially surround the exposed section of the conductor.

Preferably, the electrically conductive inner member comprises at least two shims, wherein the shims are circumferentially evenly distributed around the conductor.

Preferably, each shim is configured as a sector of a cylindrical element.

Preferably, the outer member comprises a conical inner surface and the shims comprise a conical outer surface matching the conical inner surface of the outer member.

Preferably, the counter member comprises a conical inner surface and the shims comprise a conical outer surface matching the conical inner surface of the counter member.

Preferably, the inner member is internally scored, more preferably provided with circumferentially or helically arranged grooves in an inner surface thereof.

Preferably, the inner member comprises at e two shims held together by a collapsible ring.

Preferably, the collapsible ring has bulges between adjacent ones of the shims.

Preferably, the connector comprises a second electrically conductive hollow outer member configured to at least partially surround an exposed section of a second conductor and configured to exert a force in an axial direction onto at least one second electrically conductive inner member, and the second electrically conductive inner member is configured to be interposed between the outer member and the second conductor, and configured to exert a force in a radial direction onto the second conductor in response to the force in the axial direction.

Preferably, the counter member is configured to engage with the outer member and second outer member to exert said forces in axial direction.

Preferably, the counter member is axially symmetric and is configured to contact end portions of the conductor and the second conductor, more preferably to at least partially surround the exposed sections of the conductor and the second conductor.

Preferably, the outer member(s) and the counter member have mating threads.

Preferably, the outer member(s) and the counter member have outer hexagonal profiles Preferably, the outer member(s) is(are) electrically conductive.

Preferably, the outer member(s) and the counter member are held together by a pin and groove locking mechanism.

BRIEF DESCRIPTION OF THE DRAWINGS

The features and advantages of the present invention will be made apparent by the following detailed description of some exemplary embodiments thereof, provided merely by way of non-limiting examples, description that will be conducted by making reference to the attached drawings, wherein.

Same or similar members are denoted by like numbers in the various figures.

DETAILED DESCRIPTION

Figure 1:
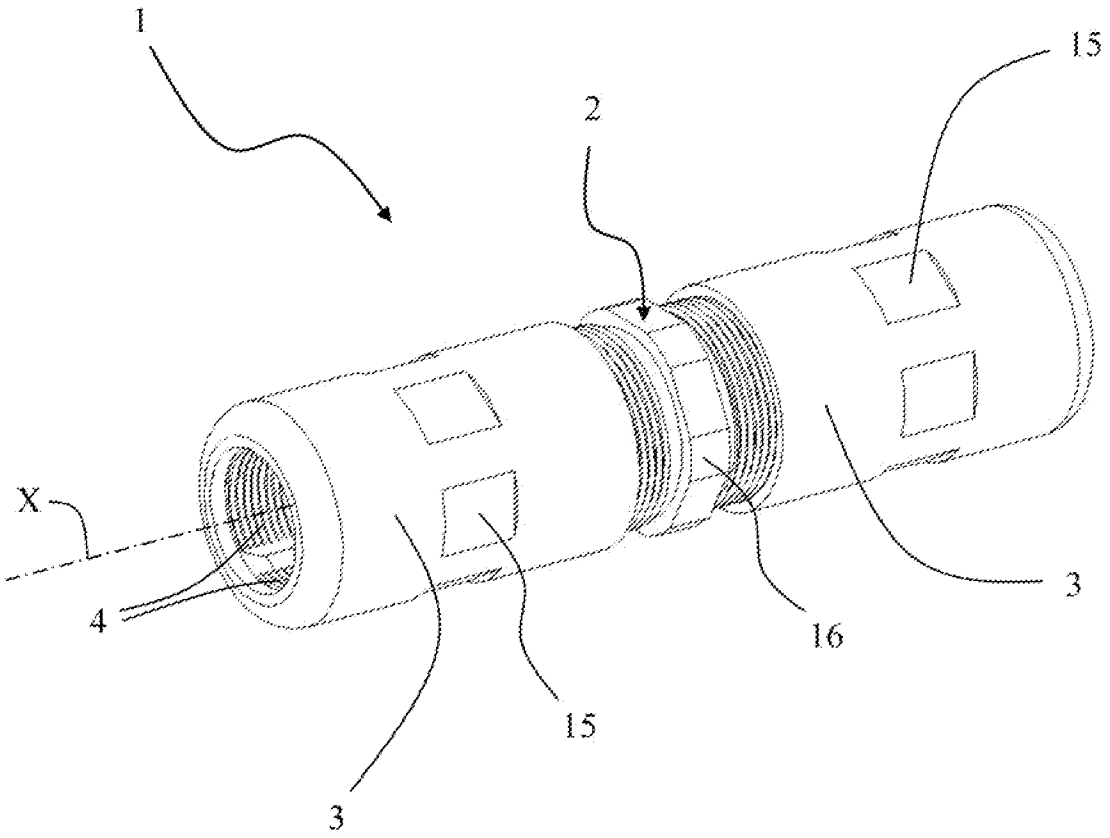
FIG. 1 schematically shows an embodiment of a connector according to the present invention, in a perspective view and in a not tight condition, FIG. 2 schematically shows a longitudinal section of the connector of FIG. 1, FIG. 3 schematically shows the connector of FIG. 1 in a partly broken away perspective view and assembled around one conductor of a cable, FIG. 4 schematically shows an embodiment of a lug according to the present invention, in a perspective view, FIG. 5 schematically shows another embodiment of a connector according to the present invention, in a partly sectional view, FIG. 6 schematically shows another embodiment of a connector according to the present invention, in a partly sectional view, and assembled around a cable, FIG. 7 schematically shows another embodiment of a connector according to the present invention, in a partly sectional view, FIG. 8 schematically shows another embodiment of a connector according to the present invention, in a partly sectional view, and FIG. 9 schematically shows another embodiment of a connector according to the present invention, in a partly sectional view.
Figure 2:
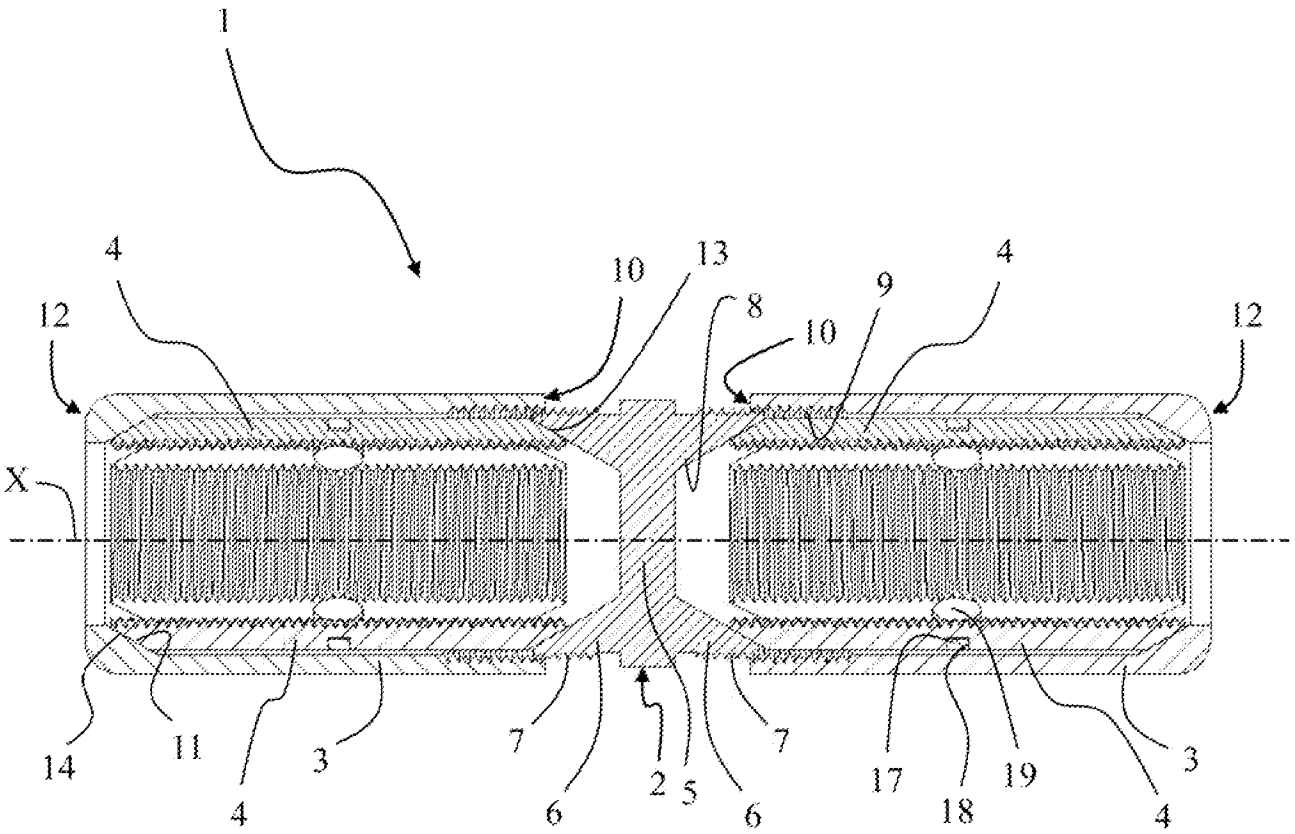
Figure 3:
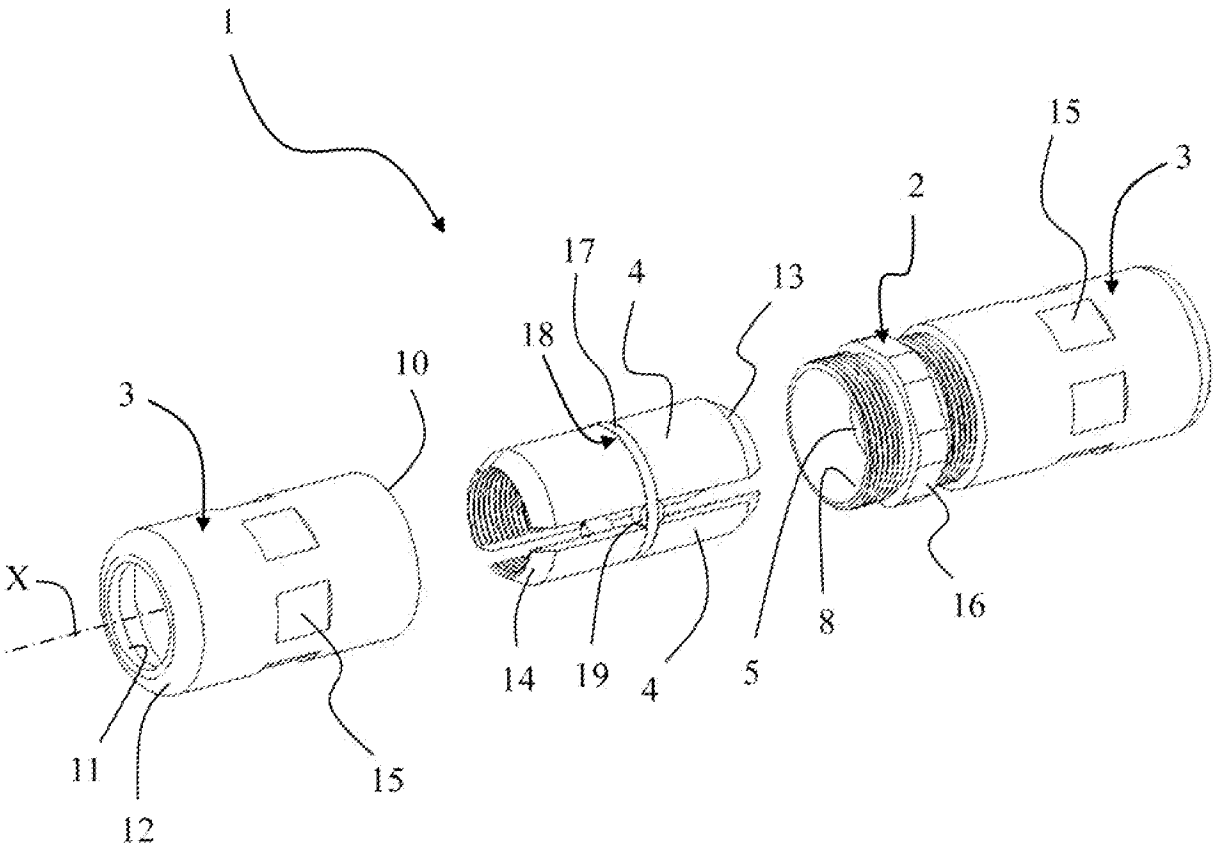

A connector 1 according to a first embodiment of he invention is disclosed with reference to FIGS. 1 to 3.

Connector 1 is shown in a perspective view and in a not tight condition in FIG. 1, in a longitudinal section in FIG. 2 and in a partly assembled perspective view and in a partly tight condition view in FIG. 3.

Connector 1 comprises a mid section 2, two outer bodies 3 and a number of shims 4. Each outer body 3 is coupled to one respective side of the mid section 2. A threaded coupling is shown in FIG. 1-3 by way of an example. A number of shims 4 is housed between each outer body 3 and the mid section 2.

More specifically, the mid section 2 comprises a central disc wall 5, which may be solid as shown or bored (compare FIG. 5), and two collars 6 each having an outer threading 7. The inner wall of each collar 6 is conical as shown at 8, specifically flared, for reasons that will be clear hereinafter.

Each outer body 3 is an essentially cylindrical hollow body. Each outer body 3 has an inner threading 9 at a first longitudinal end 10, matching and coupled with the outer threading 7 of the mid section. Each outer body 3 has an inner conical surface 11 at a second longitudinal end 12 opposed the first longitudinal end 10.

Each shim 4 is an elongate rigid member shaped as a section of a cylindrical wall, having a first and a second, conical, specifically tapered longitudinal end 13 and 14. Each longitudinal end 13 and 14 matches the conical surface 8 of flared collar 6 of mid section 2 and the conical surface 11 at the second longitudinal end 12 of outer body 3, respectively.

In use of the connector 1, a conductor C is axially inserted in one of the outer bodies 3 and its associated shim assembly 4. The end portion or free end of the conductor C is preferably brought to abutment with the flared surface 8 or the disc wall 5 of mid section 2. The mid section 2 partially surrounds the exposed section of the conductor C.

The outer body 3 is then axially moved towards the mid section 2 and coupled therewith, screwed thereto in the example shown.

Both the outer body 3 and the mid-section 2 have hexagonal profiles 15, 14 cut into the outer surface as shown, allowing the use of a wrench, preferably of a torque wrench to tighten the connector 1 to a specific torque.

The outer bodies 3 may be further locked to the mid-section 2 using a safety means to stop the connector 1 from loosening off, e.g. a pin and groove locking mechanism as disclosed below in connection with FIG. 5.

The provision of the disclosed matching conical or slanted surfaces 8, 13, and 11, 14 allows the shims 4 to be forced radially inwards, towards axis X of connector 1, when they are forced axially while the outer body 3 is coupled with the mid section 2 during tightening of the connector 1. Namely, as the length of the assembly of mid section 2 and outer body 3 decreases because of threading them together, the axial compression onto the shims 4 causes a radial compression or force of the shims 4 around and towards the conductor C. The shims 4 thus close down onto the conductor C, also becoming closer to each other.

The tightening of the outer bodies 3 to the mid section 2 can be completed using a torque wrench up to a specified torque as said.

The slant of the conical surfaces 8, 13, and 11, 14 and the length and circumferential extent of the shims 4 are properly selected so that the shims 4 may get closer to each other to clamp onto a connector C essentially all around, irrespectively of the outer diameter of the connector C within a range of outer diameters. Thus, connector 1 has range taking capability as far as the outer diameter of the conductor C is concerned.

Three shims 4 each extending slightly less than 120° are shown in the exemplary embodiment but they can be less or more than three, of a proper angular extent.

Each shim 4 preferably has a scored inner surface to promote gripping on the conductor C and also to break oxidisation of an aluminium conductor C. When aluminium reacts with oxygen in the air it develops a thin oxide film on the outer surface of the conductor C and/or on the inner surface of the shims 4. This film can affect the conductivity and therefore it is necessary to remove it just before connection, e.g. using a wire brush. Advantageously, a scored inner surface of the connector 1 will penetrate the thin oxides and will make a clean connection without the necessity to remove it manually.

Preferably, the scores on the inner surface of shims 4 comprise grooves circumferentially arranged. In one version, the grooves are helically arranged.

In order to keep together the shims 4 that are associated with a same outer body 3 or shim assembly, in the embodiment shown a collapsible spacing ring 17 extends in a groove 18 of the shims 4. This aids assembly of the connector 1 as well as mounting thereof to conductor C.

In order to preserve an equal circumferential spacing or gap between the shims 4, collapsible spacing ring 17 advantageously has a round pin or bulge 19 between adjacent shims 4. Bulges 19 maintain the orientation of the shims 4 and their spacing so as to aid fitting by allowing easy insertion of conductor C inside the shim assembly. Upon tightening the connector 1, all the bulges 19 collapse together so that the gaps between shims 4 reduce together and the circumferential distribution of contact surfaces with conductor C is kept.

The size and resistance of the bulges 19 of collapsible spacing ring 17 is so selected that the shims 4 may clamp the conductor C but are prevented to slip around the conductor and group together at the bottom of the connector 1, what would leave too great of a gap at the top of the connector 1.

Apart from the collapsible spacing ring 17, the connector 1 is made of metal, preferably of aluminium, brass or copper to ensure electrical conductivity between the two conductors C.

Collapsible spacing ring 17 is made for example of a soft rubber.

It is emphasised that the connector 1 of the invention provides for several advantages:

- the shims 4 ensure each conductor C is kept concentric to the outer surface of the connector 1, and therefore also with each other in the case of a straight joint as shown;
- thanks to bulged ring 17, the shims 4 are evenly spaced around the conductor C ensuring good surface contact and, from an electrical point of view, low electrical resistance and absence of voltage differences between the layers of strands of the conductor C;
- as seen above, the radial movement of the shims 4 allows for some range taking capability what allows less components to be manufactured, stored and carried at junction sites; moreover there is no need of providing a stepped connector in case two different diameter conductors C are to be jointed;
- range taking capability also easily allows jointing connectors C of different diameters;
- no special tool is required for installation, rather a wrench suffices;
- the connector 1 is highly resistant to axial forces, in that any attempt to withdraw the conductor C from the connector 1 will only result in tightening of the shims 4.

In an alternative embodiment, two or more collapsible spacing rings may be used for each shim assembly.

In an alternative embodiment, the shims may have bevelled end(s) and the outer body and/or the mid section may have flared surface(s).

In an alternative embodiment, only one or two of the ends of the outer body and the mid section may be bevelled or conical.

In other embodiments, interchangeable shims and/or either interchangeable outer bodies or mid sections may be provided to further extend the range take with respect to the diameter of conductor C.

Figure 4:
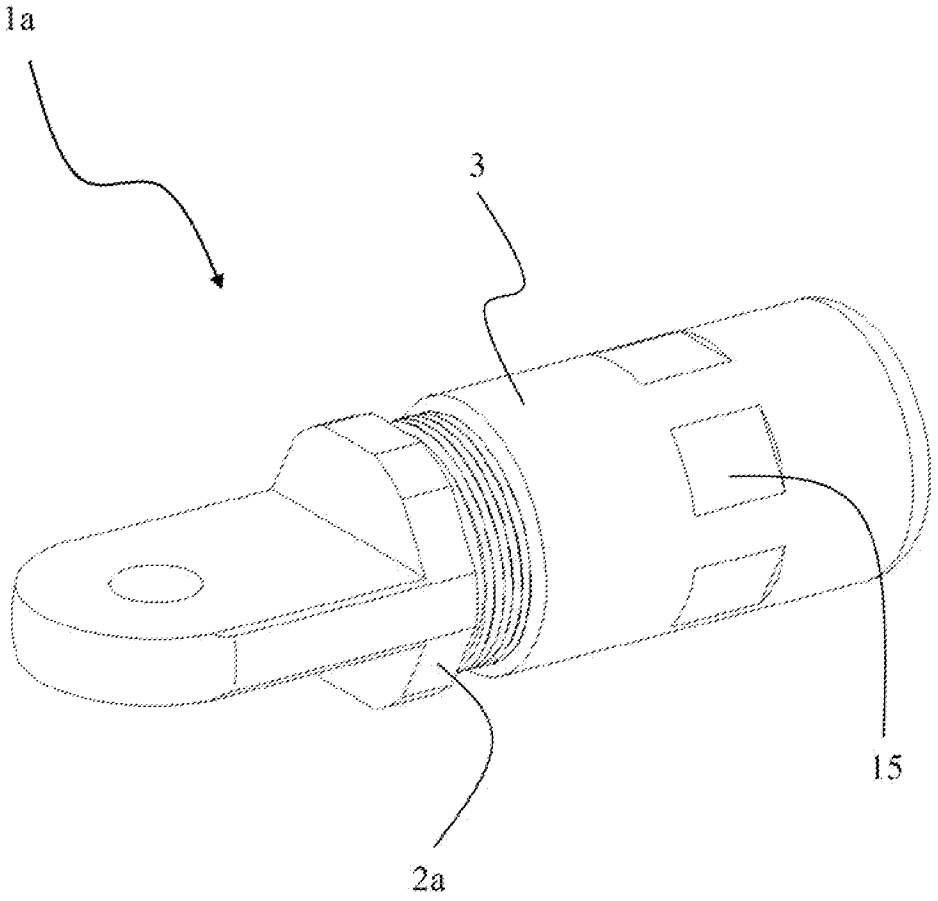

FIG. 4 shows a termination lug 1*a* wherein instead of one symmetrical mid section 2 and two outer bodies 3 as disclosed thus far, only one outer body 3 and one lug 2*a* that plays the role of one half mid section and that is shaped to allow e.g. ground or mass connection are used. Shims (not visible in FIG. 4) as discussed above are provided within the single outer body.

Although the threaded engagement of mid section 2 and outer bodies 3 or lug 2*a* is particularly advantageous because it allows tightening by a usual wrench, different tightening mechanisms and use of specialized tooling may be provided. A torque limiting device that indicates the connector is tight may also be provided for.

Figure 5:
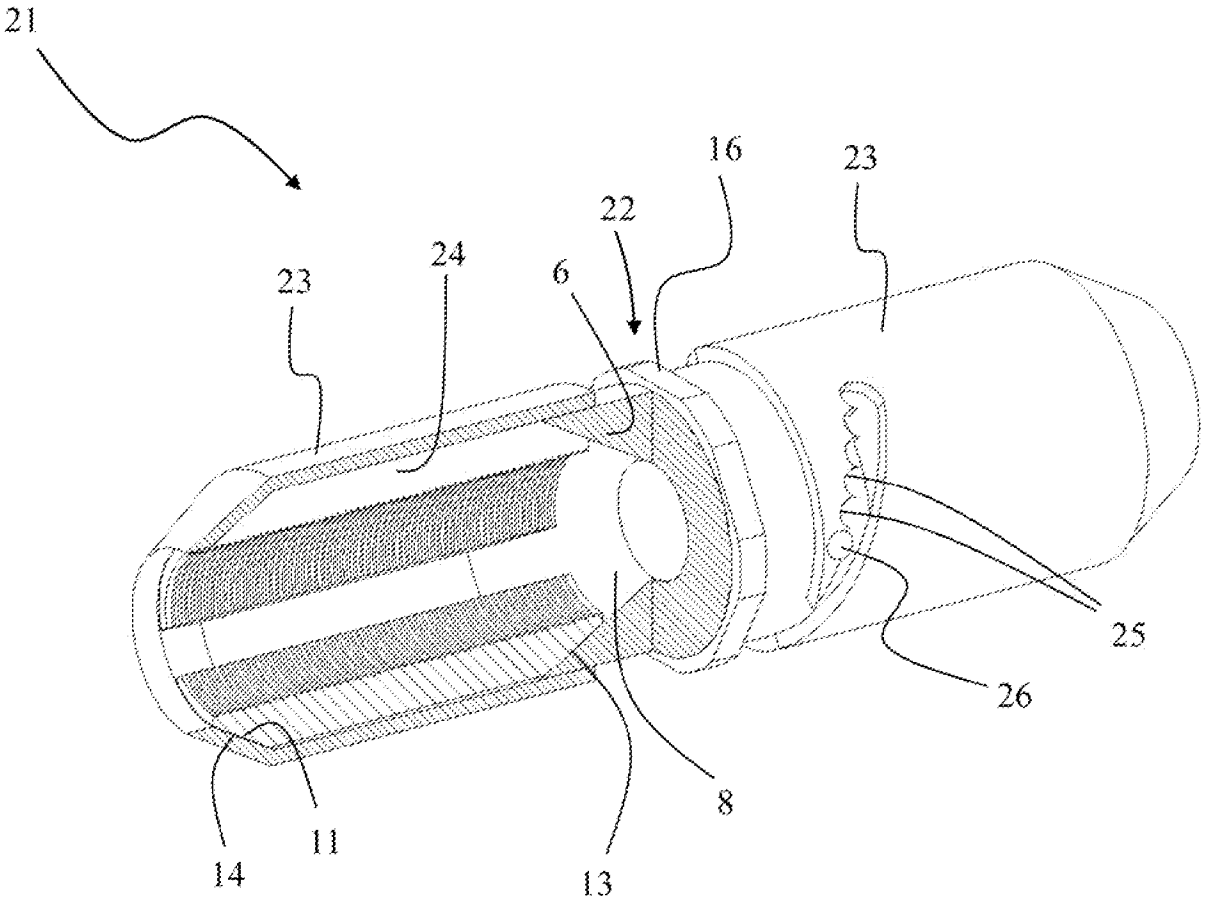

By way of an example, FIG. 5 shows a connector 21 differing from connector 1 in that instead of a screw thread coupling, a pin and groove locking mechanism is used, resembling a bayonet coupling. As the connector outer body 23 is turned to lock the conductor C, a pin 26 of the mid section 22 clicks into one of a plurality of grooves 25 in the side of the outer body 23, that are arranged at different longitudinal positions along a diagonal groove wherein the pin 26 can slide. There may be provided one groove 25 for each of a plurality of specific size conductors C. An increasing depth of engagement of the outer body 23 with the mid section 22 will again cause an increasing clamping of the shims around the conductor C.

Two diametrically opposed pins 26 and corresponding grooves 25, or a larger number thereof, may also be provided to increase the axial force onto the shims.

As mentioned, the screw thread coupling of FIG. 1 and the pin and groove locking mechanism of FIG. 5 may be both provided for in a single connector, to enhance the coupling.

Figure 6:
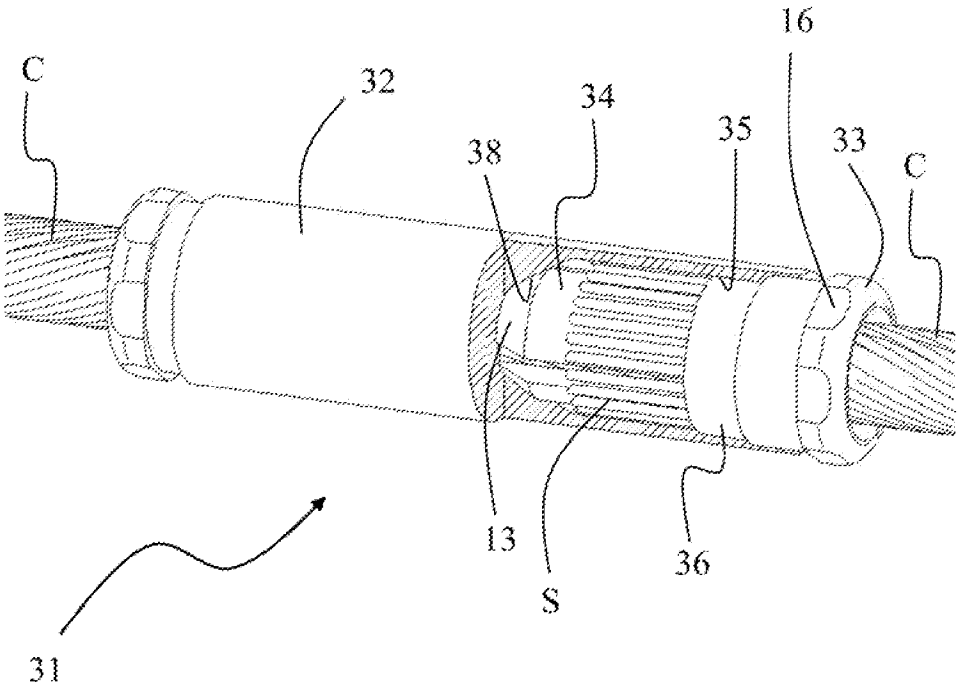

FIG. 6 shows a connector 31 that differs from that of FIGS. 1-3 in that the mid section 32 is made longer, and comprises an internal cylindrical wall 35 adjacent a conical surface 38 at an intermediate position thereof. The outer bodies 33 having a hexagonal profile 16 are matingly threaded with the mid section 32, internally thereto, and exert an axial force onto the shims 34 through a clamping ring 36 having a conical inner surface 37 (not visible).

In use, an outer layer of conductor strands S is splayed and spread outside the shims 34, and held by clamping ring 36, As the connector 31 is tightened the shims 34 clamp onto the inner layers of strands whilst the outer layer of strands S is held by the clamping ring 36. This advantageously produces a great surface contact between connector 31 and conductor C for an improved electrical connection.

The differences highlighted above may be individually provided as a modification of the connector 1 of FIGS. 1-3.

Figure 7:
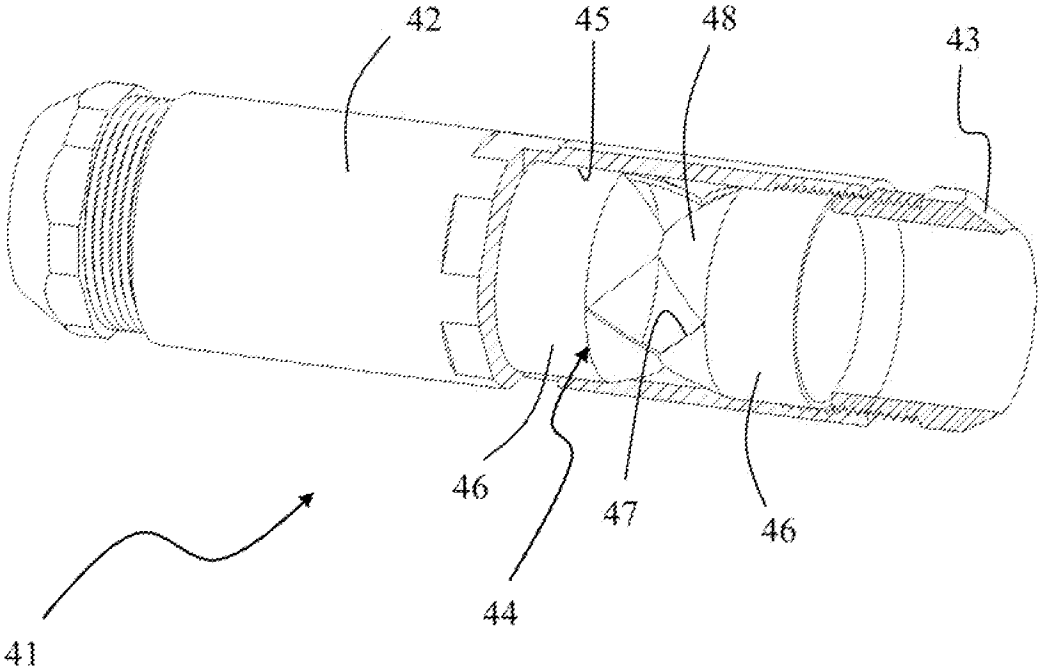

FIG. 7 shows a connector 41 wherein again the mid section 42 is made longer, and comprises an internal cylindrical wall 45 and no conical surface. The outer bodies 43 are e.g. matingly threaded with the mid section 42 and exert an axial force onto a collapsible inner member 44.

Collapsible inner member 44 is a tube shaped body comprising two end collars 46 and an intervening portion that comprises apertures 47.

More specifically, apertures 47 are rhomboidal and each wall 48 between two such apertures is hourglass-shaped. Moreover each wall 48 is so slanted with respect to the collars 46 that the neck of the hourglass-shaped wall 47 lies on a smaller circumference than the collars 46.

When the connector 41 is tightened, inner member 44 collapses and the hourglass-shaped walls 48 indent onto the conductor C.

In order to increase the grip and electrical contact, more than one series of apertures 47 and hourglass-shaped walls 48 might be provided along the length of the inner member 44.

Figure 8:
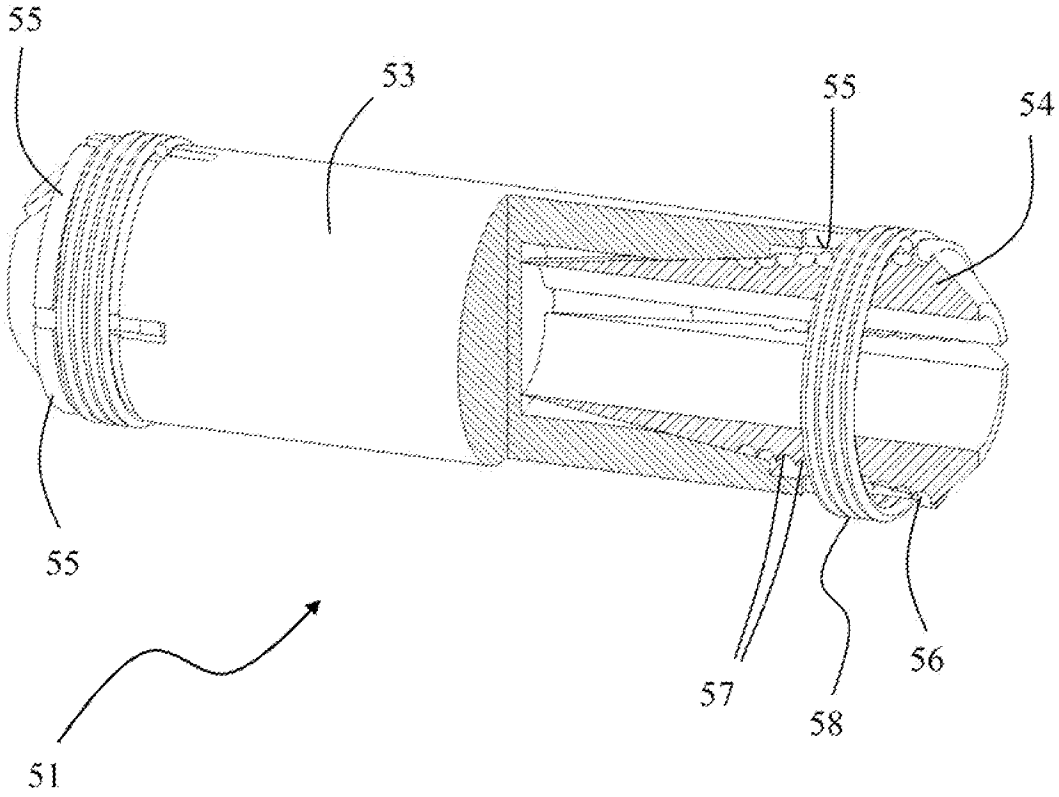

FIG. 8 shows a connector 51 wherein the two outer bodies 53 are one piece, mid section missing. Each outer body has, at its cable-side end, two or more fingers 55 having a radially inward protruding collar 56. Conical shaped shims 54 having at least one groove 57 are forced inside the fingers 55 against the action of a spring 58 that surrounds the fingers 55. As the shims 54 are pushed further in, they clamp the conductor C and are locked in by the radially inward protruding collars 56 of the fingers 55. Collars 56 exert an axial force onto the shims 54 against axial displacement thereof.

Figure 9:
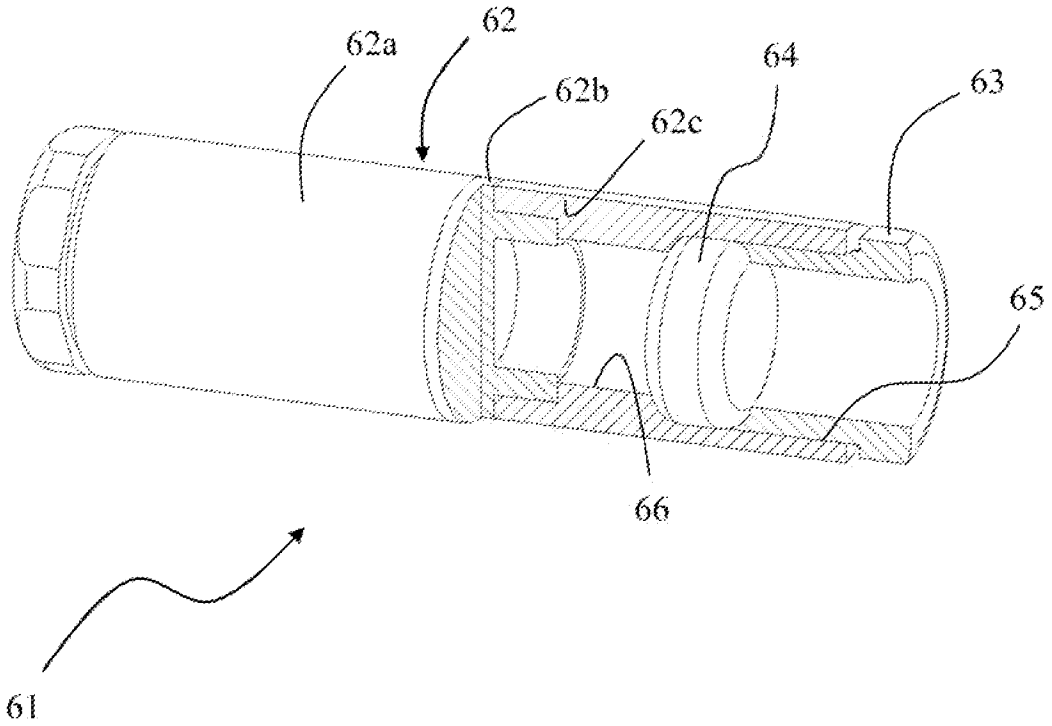

FIG. 9 shows a connector 61 wherein again the mid section 62 is made longer, and in this case is preferably comprised of three parts 62*a*, 62*b*, 62*c* threaded together. Lateral parts 62*a*, 62*c* preferably have female threading and intermediate part 62*b* preferably has two male threading matching therewith. Mid section 62 comprises a first internal cylindrical wall 65 having a first diameter at the cable side, and a second internal cylindrical wall 66 having a second diameter smaller than the first diameter and adjacent the first cylindrical wall 65.

Each outer body 63 is matingly threaded with the mid section 62, internally thereto, and exerts an axial force onto a collapsible inner member 64 axially forcing it towards the step formed by the second internal cylindrical wall 66. Collapsible inner member 64 is in the form of an O ring having an olive-shaped cross section.

In the various embodiments, the outer body(ies) or outer member(s) exert a force in an axial direction onto the shims or inner member(s), which in turn exert(s) a force in a radial direction onto the conductor(s) C. As said terms outer and inner are used relative to each other, not with an absolute meaning. Indeed, in the embodiments of FIGS. 6, 7, 9 the mid section 32, 42, 62 is outer with respect to the outer bodies 33, 43, 63.

In the various embodiments, the mid section, where provided for, acts as a counter member configured to engage with the outer member(s) to exert the force in axial direction.

In the various embodiments, the mid section where provided for may be split into two or three portions connectible with each other as shown in FIG. 9 or with flanges connected through bolts, so that each of two conductors C may first be independently coupled to a respective connector half. This may simplify the assembly operation.

The connectors of the invention are suitable for connecting the inner conductor of a coaxial power cable, or each conductor of a non coaxial power cable.

In other embodiments, the inner face of shims 4 may depart from a portion of a cylindrical wall to better adapt to shaped conductors such as lobe shaped conductors or to cables having conductors lying in a plane.

The collapsible spacing ring 17 of the embodiment of FIGS. 1-3 can be provided for in the other embodiments also.

As said in connection with FIG. 8, the mid section may be missing, the two outer bodies being one piece. In other embodiments, the mid section may be missing, the two outer bodies being coupled to each other, such as by providing an outer threading of one outer body and a matching inner threading of the other outer body, or through bolted flanges.

It is highlighted that in the above embodiments the conductor C is held almost about its entire circumference, instead of using screws that screw inside the conductor, that might damage the strands or create voltage differences among them.

Experimental testing showed that the connectors of the invention perform well both in terms of resistance to traction and in electrical terms.

The invention claimed is:

1. A connector o a conductor of a power cable comprising:

a hollow outer member configured to at least partially surround an exposed section of the conductor and configured to exert a force in an axial direction onto at least one electrically conductive inner member, said at least one electrically conductive inner member configured to be interposed between the outer member and the conductor, and configured to exert a force in a radial direction onto said conductor in response to said force in the axial direction, and said at least one electrically conductive inner member comprising at least two shims, wherein said at least one electrically conductive inner member further comprises a collapsible ring whereby said at least two shims are held together.

2. The connector as claimed in claim 1, wherein said connector further comprises a hollow counter member configured to contact an end portion of the conductor, and said outer member is configured to engage with said counter ember to exert said force in the axial direction.

3. The connector as claimed in claim 1, wherein said at least two shims are circumferentially evenly distributed around said conductor.

4. The connector as claimed in claim 3, wherein each of said at least two shims is configured as a sector of a cylindrical element.

5. The connector as claimed in claim 1, wherein said outer member comprises a conical inner surface and said at least two shims comprise a conical outer surface matching the conical inner surface of the outer member.

6. The connector as claimed in claim 2, wherein said counter member comprises a conical inner surface, and said at least two shims comprise a conical outer surface matching the conical inner surface of the counter member.

7. The connector as claimed in claim 1, wherein said at least one inner member is internally scored.

8. The connector as claimed in claim 1, wherein said collapsible ring has bulges between adjacent ones of said at least two shims.

9. The connector as claimed in claim 1, wherein the connector comprises a second electrically conductive hollow outer member configured to at least partially surround an exposed section of a second conductor and configured to exert a force in an axial direction onto at least one second electrically conductive inner member, said at least one second electrically conductive inner member configured to be interposed between the second outer member and the second conductor, and configured to exert a force in a radial direction onto said second conductor in response to said force in the axial direction.

10. The connector as claimed in claim 9, wherein said connector further comprises at least one counter member, wherein said counter member is axially symmetric and is configured to contact end portions of said conductor and said second conductor, and to engage with said outer member and second outer member to exert said forces in axial direction.

11. The connector as claimed in claim 2, wherein said outer member and said counter member have mating threads.

12. The connector as claimed in claim 2, wherein said outer ember and said counter member have outer hexagonal profiles.

13. The connector as claimed in claim 1, wherein said outer member is electrically conductive.

14. The connector as claimed in claim 1, wherein said outer member and said counter member are held together by a pin and groove locking mechanism.

15. A connector for a conductor of a power cable comprising:

a hollow outer member configured to at least partially surround an exposed section of the conductor and configured to exert a force in an axial direction onto at least one electrically conductive inner member, said at least one electrically conductive inner member configured to be interposed between the outer member and the conductor, and configured to exert a force in a radial direction onto said conductor in response to said force in the axial direction, and said at least one electrically conductive inner member comprising at least two shims, wherein said at least two shims are circumferentially evenly distributed around said conductor, and wherein each of said at least two shims is configured as a sector of a cylindrical element.

* * * * *